United States Patent [19]

Searle

[11] 4,363,294

[45] Dec. 14, 1982

[54] PISTON AND CYLINDER MACHINES

[76] Inventor: Russell J. Searle, 1, Thames Corner, Thames Street, Sunbury-on-Thames, Middlesex, England

[21] Appl. No.: 41,902

[22] Filed: May 22, 1979

[30] Foreign Application Priority Data

May 25, 1978 [GB] United Kingdom ..... 22849/78
Dec. 14, 1978 [GB] United Kingdom ..... 48553/78

[51] Int. Cl.[3] ..... F02B 57/00; F02B 75/26

[52] U.S. Cl. ..... 123/43 A; 123/58 BA; 123/193 P; 92/70; 92/57; 277/138

[58] Field of Search ..... 123/43 R, 43 A, 43 C, 123/58 R, 58 A, 58 AA, 668, 669, 18 R, 193 P; 277/138; 92/70, 57

[56] References Cited

U.S. PATENT DOCUMENTS

| | | | |
|---|---|---|---|
| 1,228,101 | 5/1917 | Dutton | 123/43 A |
| 2,456,164 | 12/1948 | Youhouse | 123/43 A |
| 3,126,835 | 3/1964 | Kline | 123/43 A |
| 3,326,193 | 6/1967 | Wahlmark | 123/43 A |
| 3,654,906 | 4/1972 | Airas | 123/43 A |
| 3,970,055 | 7/1976 | Cong | 123/43 A |
| 4,022,168 | 5/1977 | Sprague | 123/43 A |
| 4,138,930 | 2/1979 | Searle | 123/43 A |

*Primary Examiner*—Ronald B. Cox
*Attorney, Agent, or Firm*—Murray and Whisenhunt

[57] ABSTRACT

A piston and cylinder machine, e.g. an engine or pump, in which the cylinder rotates about a first axis from which the cylinder is spaced, and the piston rotates about a second axis inclined to the first with the result that during the rotation, the piston reciprocates relative to the cylinder. Gas flow is controlled by a rotary valve which communicates with the cylinder and which rotates about an axis parallel to or coincident with the first axis. The piston is maintained in position relative to the cylinder by restraining means in the form, for example, of flat abutment surfaces provided between the piston and a spherically-surfaced piston ring thereon so as to limit lateral movement of the piston ring relative to the piston.

6 Claims, 9 Drawing Figures

| ROTATION | | | | | |
|---|---|---|---|---|---|
| CYLINDERS | 0 | 120 | 240 | 360 | 480 |
| VALVE | 0 | 180 | 360 | 540 | 720 |

PISTON AND CYLINDER MACHINES

This invention relates to a piston and cylinder machine, e.g. an engine or pump.

According to the invention, there is provided a machine comprising:

a cylinder having a straight sided bore spaced from a first axis, a piston assembly including a piston which is disposed within said cylinder bore to form a chamber therein, the piston assembly further including a connecting portion connected to the piston and restraining means for resisting any tendency for the piston to move in relation to the cylinder about the first axis, an inclined member mounted for relative rotation between the inclined member and the cylinder to occur about the first axis, the inclined member being inclined to the first axis along a second axis and the said connecting member being engaged with the inclined member such that said relative rotation of the cylinder and the inclined member is accompanied by reciprocation of the piston within the cylinder, and a rotary valve which communicates with said chamber and which rotates about an axis parallel to or coincident with said first axis.

Figure 1:
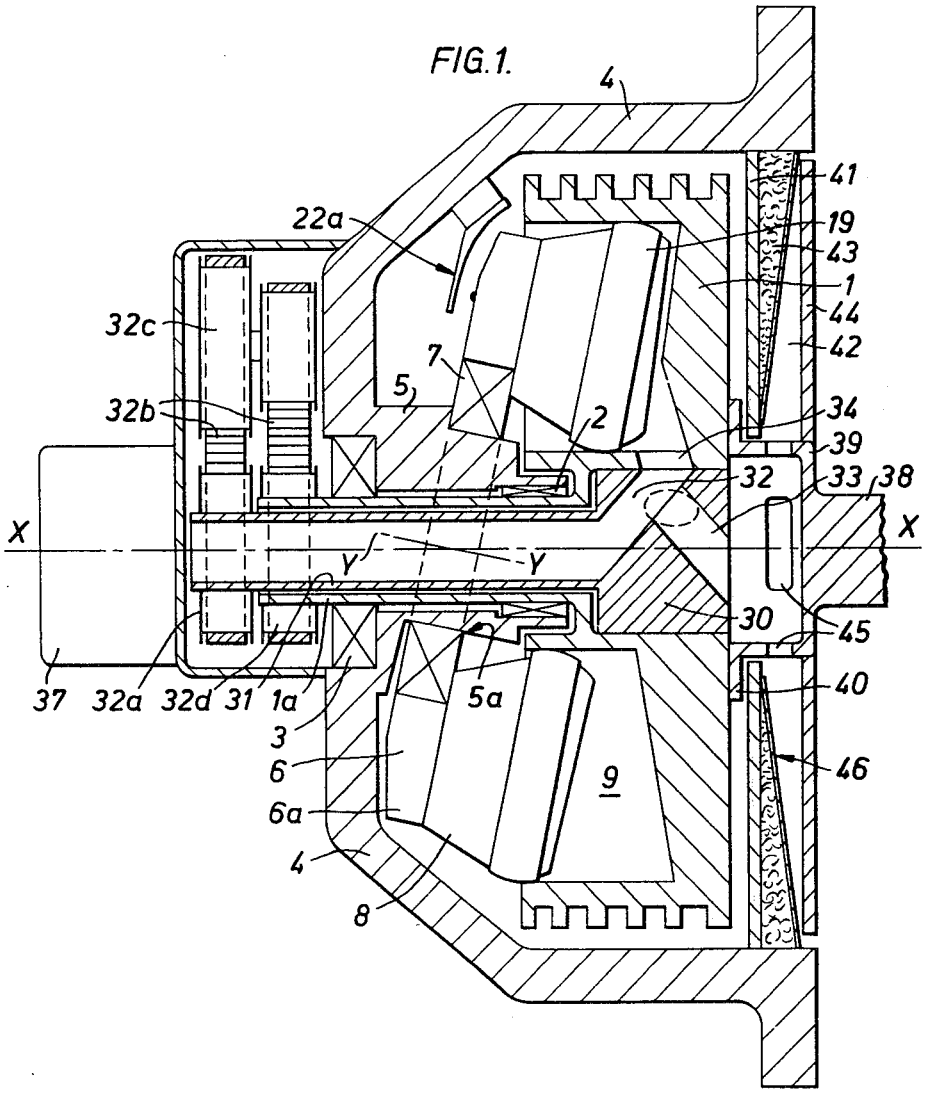
Figure 2:
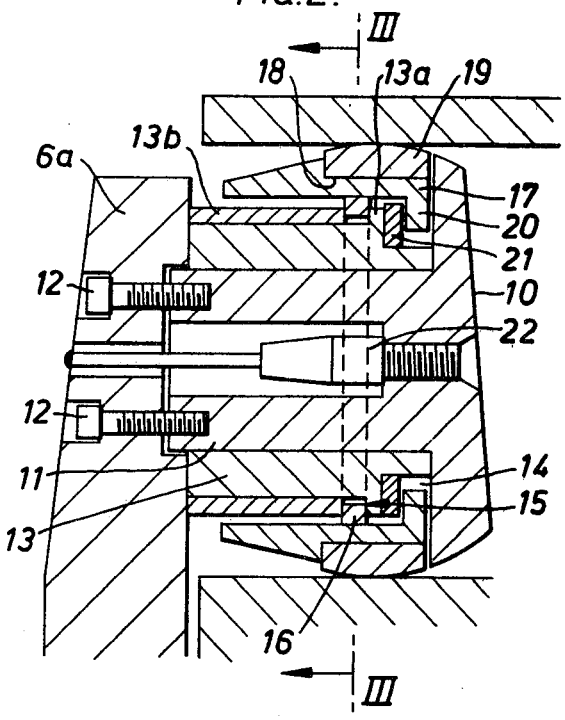
Figure 4:
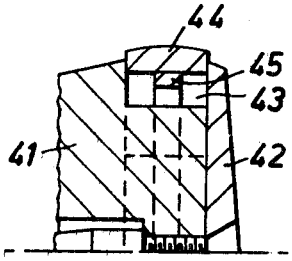
Figure 3:
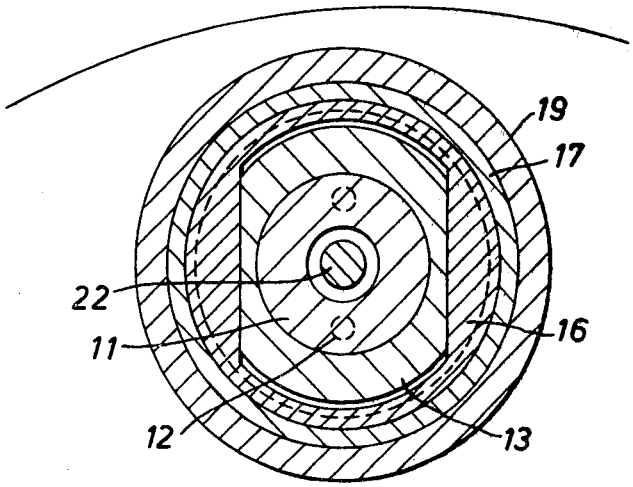
Figure 5A:
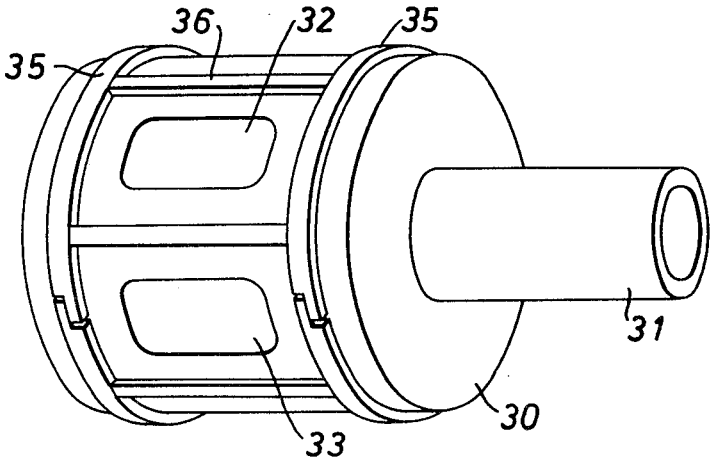
Figure 5B:
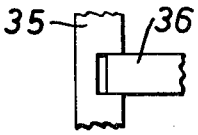
Figure 5C:
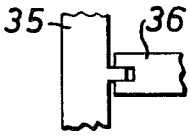
Figure 5D:
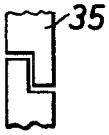
Figure 6:
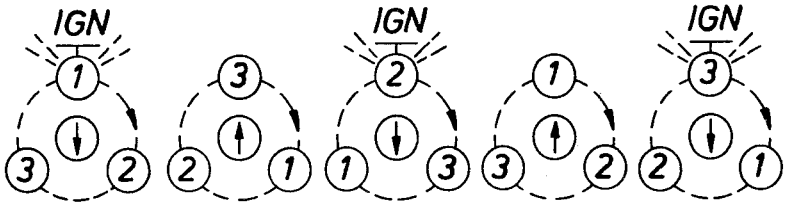

For a better understanding of the invention, and to show how the same may be carried into effect, reference will now be made, by way of example, to the accompanying drawings, wherein:

FIG. 1 is a diagrammatic partly sectional elevation of an engine,

FIGS. 2 and 3 are a sectioned side view and a sectioned plan view respectively of a piston used in the engine of FIG. 1, FIG. 4 is a sectioned side view of a part of a modified piston, FIG. 5*a* is a perspective view of a valve used in the engine of FIG. 1, FIGS. 5*b* to 5*d* are explanatory diagrams relating to FIG. 5*a*, and FIG. 6 is a series of diagrams showing the operating sequence of a valve used in the FIG. 1 engine.

The engine of FIG. 1 comprises a cylinder assembly including a cylinder block 1 formed with an axially extending hollow shaft portion 1*a*. The shaft portion 1*a* is mounted in bearings 2 and 3 so that the whole cylinder assembly can rotate about an axis X. The cylinder block 1 is enclosed in a stationary casing 4 having a hollow projecting portion 5 which extends inwardly from one end of the casing and which forms a housing for the bearings 2 and 3. Part of the portion 5 defines a cylindrical surface 5*a* of which the axis y is inclined to the axis x. A piston assembly 6 is supported on this surface by way of a bearing 7 such that the piston assembly can rotate about axis y. The piston assembly comprises a connecting member 6*a* which is mounted at its centre on the bearing 7 and which has three radially extending portions to each of which is attached a piston 8, each piston being disposed within a respective cylinder bore 9 in the cylinder block 1. Rotation of the cylinder assembly about the axis X is accompanied by rotation of the piston assembly about the axis Y and, since axes X and Y are inclined to one another, such rotation is further accompanied by reciprocation of each piston relative to its respective cylinder bore.

As mentioned there are three pistons and correspondingly, the cylinder block has three bores, these being arranged equidistant about axis of rotation X. In FIG. 1 to better illustrate the construction, only two pistons and two bores are shown spaced at 180° whereas in fact there are three and they are spaced at 120° intervals.

As shown in FIGS. 2 and 3, each piston 8 comprises a part defining a sloping piston crown 10 and a spigot 11 which extends back from the crown 10 and is attached by screws 12 to the connecting member 6*a*. Disposed around the spigot 11 between the connecting member 6*a* and the crown 10 is a cylindrical member 13 of which the end next to the crown 10 is reduced in diameter so as to form shoulder which, with the rear of the crown 10, defines a circular recess 14. A short way back from this end of the member 13, there is an annular flange 13*a* and round the member 13 there is a further cylindrical member 13*b* which has the same external diameter as the flange 13*a*, and which extends from the other end of the member 13 up to a short distance from the flange 13*a* such that there is defined a groove or channel 15 between the flange 13*a* and member 13*b*. In this groove 15 there is disposed a ring-shaped member 16 with clearance between the inner surface of the ring-shaped member 16 and the floor of the groove 15 so that the member 16 can move as a whole laterally with respect to the member 13. In one and only one of the pistons 8, the groove 15 and member 16 are as shown in FIG. 3, that is with two opposite "flats" and only sufficient clearance between the flat portions of the inner surface of the member 16 and the flat portions of the floor of the groove 15 to allow sliding movement. Thus, for this piston 8, the movement of the member 16 with respect to the member 13 is restricted to the directions towards and away from the axis Y in FIG. 1. Fitted closely around the member 16 such that there is clearance between it and the member 13, is a collar 17 which is formed with a recess 18 for receiving a continuous piston ring 19 (i.e. a ring which is continuous all around its circumference instead of being split as in conventional piston rings) and with an inwardly directed flange 20 which extends into the recess 14. Between the flange 20 and that wall of the recess 14 which is formed by the shoulder of the member 13 there is disposed a thrust bearing spacer annulus 21 to take the thrust exerted by the piston ring 19 via the collar 17. The piston ring 19 has an external periphery in the shape of an equatorial region of a sphere of diameter equal to that of the cylinder bore. An ignition plug 22 is screwed into a threaded bore formed in the piston crown 10 such that the plug can ignite fuel/air mixture within the cylinder. It will be appreciated from a consideration of FIG. 1 that, as each piston 8 reciprocates with respect to its cylinder, it moves along an arcuate path such that its distance from axis X changes during the reciprocation. This change in distance is taken up by the lateral movability as a whole of the ring-shaped member 16 and hence also of the collar 17 and piston ring 19, each as a whole, with respect to the member 13. The limitation of this movement, for one of the pistons, to the direction towards and away from the axis X ensures that the piston assembly is restrained from rotation in relation to the cylinder block and the pistons remain substantially central within the cylinder bores.

Each piston crown 10 and/or the end surface of each cylinder could be coated with ceramic material to reduce heat loss from the combustion chamber.

The construction of the piston may be modified in various ways. For example, instead of having the relatively complex internal structure shown in FIGS. 2 and 3, it could comprise a simple main body part 41 and a removable crown 42 as shown in FIG. 4, the body part 41 being shaped such that between it and the crown 42 there is formed a groove 43 for the piston ring 44. The floor of the groove is circular but with two opposite "flats", i.e. the same shape as the groove 15 in FIG. 3. Then, for one of the pistons, there is provided an intermediate ring-shaped member 44 which also has two opposite "flats" on its internal surface which mate with the flats of the floor of the groove 43 and limit the relative movement of the piston ring 44 of this piston to the directions towards and away from the axis X in FIG. 1. The intermediate ring 44 is not provided in the other pistons so that, here, the piston ring can move in all directions laterally with respect to the piston.

Instead of being continuous, the piston ring could be split at a point on its circumference in the manner of a conventional piston ring. Then it is preferred that the split should follow a diagonal, cranked or other tortuous path across the width of the ring so as to reduce the possibility of gas leakage through the split. The piston ring 19 could be made of synthetic plastics material or metal, or metal which is coated with synthetic material or plated with another metal. The main criteria is that the material forming the surface which contacts the cylinder should be compatible with the cylinder material or the material of the cylinder liner if these are provided. If the chosen ring material is such that allowing for relative coefficients of expansion of this material and the cylinder material and the different temperature rises which they may undergo during operation of the engine, the ring material will expand more than the cylinder, it may be necessary to give the ring a composite construction. For example, each piston ring 19 may consist of two concentric rings one within the other and bonded or shrunk together the outermost ring being profiled to form the equatorial zone of a sphere of a diameter equal to the diameter of the cylinder. Then, to maintain a constant sealing clearance between the profiled ring and the cylinder, the coefficients of expansion of the two rings and the cylinder are chosen so that the following condition applies:

$$D_1X_1t_1=D_2x_2t_2+2wx_3t_3$$

where t1, t2 and t3 are the respective temperature rises of the cylinder and the inner and outer rings during operation of the engine, $D_1$ and $D_2$ are the diameters of the cylinder bore and the inner ring respectively and, $x_1$ = coefficient of expansion of cylinder
$x_2$ = coefficient of expansion of inner ring
$x_3$ = coefficient of expansion of outer ring
w = radial thickness of inner ring.

The function of the inner ring could be taken over by the collar 17, i.e. the ring itself being made in one piece and of material having a coefficient of expansion $x_3$ and the material of the collar 17 having a coefficient $x_2$. A combined rotary inlet and exhaust valve 30 is mounted in a valve housing formed in the cylinder block 1. The valve has a tubular extension 31 which passes through and is rotatable in the hollow shaft 1*a* of the cylinder block.

Referring to FIG. 5*a* as well as FIG. 1, the valve itself comprises a cylindrical member with ports 32 and 33 formed therein. Port 32 leads from the interior of the tubular extension 31 to one position on the cylindrical surface of the valve and the port 33 leads from another position on this surface to the end of the valve furthest from the extension 31. A port 34 in the wall of each cylinder leads to the valve so that each cylinder port 34 communicates periodically with each of the ports 32 and 33. Fuel/air mixture is made available to the port 32 via the interior of the extension 31 and exhaust gases are emitted via port 33. That end of the extension 31 which protrudes from the end of the cylinder block shaft portion 1*a* is fitted with a toothed pulley wheel 32*a* which is coupled via two toothed belts 32*b* and two intermediate pulleys 32*c* to a pulley 32*d* which is fitted to the shaft portion 1*a*. The pulleys 32*c* are of such relative size that the valve 30 is rotated at one and a half times the speed of the cylinder block. To maintain the belts in position on the pulleys 32*a*, 32*c* and 32*d* and to prevent the belts from jumping teeth on the pulleys and thereby changing the relative positions of the different pulleys, spring mounted idler pulleys (not shown) are arranged to press on the outer surfaces of the belts at appropriate positions near the other pulleys.

Because of the relative speeds of the cylinder block and valve, gas is induced, compressed and ignited, expanded and exhausted in each cylinder once per two revolutions of the system, the positions on the surface of the valve where the ports 32 and 33 open being such as to give correct timing of these functions. FIG. 6 shows the relative positions of the rotary valve as each cylinder moves into the top dead centre position. It requires two revolutions after the first position shown i.e. ignition in cylinder 1, for the valve to be again in the correct position for ignition in cylinder 1.

At each end of the valve 30 there is a groove containing a spring ring 35. Extending between the two rings 35, one on that side of each of the ports 32 and 33 which is furthest from the other port and one between the two ports, are lengthwise grooves each containing a sealing strip 36, each end of each strip being engaged with the adjacent ring 35 so as to allow differential expansion of the rings and strips while enabling the strips to be maintained in position and to be sprung outwardly by the rings 35 against the surface of the valve housing formed in the cylinder block. For example, the strips may be engaged with the rings by the means shown in FIGS. 5*b* and 5*c*. Each ring is split, the ends at the split being stepped as shown in FIG. 5*d*. The rings and strips provide "piston ring" type sealing between the valve and the valve housing. As an alternative to what is shown, the rings and strips could be mounted in grooves in the internal surface of the valve housing and arranged to spring inwardly onto the valve, in which case only two strips are necessary.

The carburettor 37 is stationary and communicates with the inlet passage through the tubular extension 31 of the rotary valve via a rotating seal, inlet gases passing through the inlet passage in the valve and into the cylinder port 34. The valve remains open during the induction stroke and is closed during the compression and ignition stroke. The exhaust passage 33 in the valve communicates with the cylinder port 34 during the exhaust stroke.

The engine drive shaft 38 has a hollow, enlarged end 39 which is fixed by means of a flange 40 to the cylinder block around the valve housing therein. Fixed within the casing 4, around the enlarged end 39, is a partition plate 41 which bounds one side of a chamber 42 containing sound deadening material 43 such as glass or wire wool. The other side of the chamber is bounded by a plate 44 fixed to shaft 38. The diameter of the plate 44 is such that there is left a gap all round the periphery of the chamber. Exhaust gases pass from the port 33 into the hollow end 39 of shaft 38 and then via radial ports 45 in this end to the chamber 42 where they pass over the sound deadening material 43 and thence to the exterior via the open periphery of the chamber. The sound deadening material 43 is held in place by a dished member 46 made of perforated metal for example.

Various alternative exhaust systems could be used instead of the particular one shown. For example, a stationary exhaust manifold may communicate with the port 33 by way of a sliding or labyrinth seal, there then being provided a stationary silencer which may be remote from the engine, or the plate 41 in the illustrated arrangement could be replaced by a shallow cylindrical dish fixed to the shaft portion 39 instead of to the casing 4 so that the whole of the silencer system rotates with the shaft.

The ignition plugs 22 communicate cyclically with an electrical contact 22*a* fixed to the casing. The ignition make and break (not shown) is operated on a single lobe cam from an extension to the shaft carrying the idler timing pulleys or gears 32 which if arranged to rotate at valve speed i.e. $1\frac{1}{2}$ time engine speed will produce a spark at each revolution of the valve and ignite consecutively cylinders 1, 2 and 3 as shown in FIG. 5.

The rotary valve and its housing are made of material of a similar coefficient of expansion, for example aluminium alloy, one valve sealing surface being coated with a high temperature synthetic polymer, or a metal mixed with synthetic polymer, graphite, molybdenum disulphide or other lubricative material, the other hardened by anodising or having a coating of metal, ceramic or synthetic polymer compatible with the mating surface. The coated surfaces may be sprayed, for example, by means of a plasma arc gun, with particles of the coating material or alternatively the coating may be plated or deposited chemically or mechanically onto the valve sealing surface. The coating is sufficiently thin to ensure that over the temperature range to which the valve is subjected the sealing clearance between the valve and its housing remains substantially constant.

Air cooling ducts may be formed in the cylinder block comprising for example three parallel holes intermediate to the cylinder bores and adjacent to the rotary valve which communicate with a series of radial holes passing to the outer periphery of the block, thus air is centrifuged out through the radial holes and drawn in along the parallel holes.

The engine could have a number of cylinders other than three the relative speed of rotation of the rotary valve and cylinder block then being appropriately set to give two or four stroke operation of the engine as desired. For a three cylinder engine only one of the piston rings is restricted in its lateral movement with respect to its associated piston, the other two rings being able to move in all directions laterally so as to take up the relative sideways changes in position which occur between the associated pistons and cylinders. In an engine having other than three cylinders it may be possible for say two of the piston rings to be restricted in the direction in which they move this depending upon the geometry of the relative movement between piston and cylinder assemblies of the engine concerned.

Furthermore, instead of or in addition to this illustrated means for preventing circumferential movement of the pistons relative to the cylinders about the axis of rotation of the engine by restricting the piston ring movement, i.e. the flat parallel portions in the piston and the correspondingly shaped intermediate member as shown in FIG. 3, the piston rotor and cylinder block could be coupled together by way of a linear bearing arrangement as disclosed in UK patent specification No. 1,511,232 for example, the arrangements comprising the members 103, 104 and such illustrated in FIG. 10 of the drawings of that specification.

Instead of being as shown, the cylinder block of the engine could rotate about axis Y and the pistons about axis X.

Furthermore, instead of the piston(s) and cylinder(s) rotating it could be the member 5 in FIG. 1 which rotates, the member 5 instead of being formed as part of the engine casing being coupled to an engine output shaft for example to rotate with it. It will be appreciated that the basis operation of the engine is still the same since it is the relative rotation of the member 5 and the piston/cylinder assembly which produces or which is produced by the reciprocation of the pistons in the cylinders. Machines wherein the support member rotates and the piston/cylinder assembly does not are disclosed in specification No. 1,511,232 and the present invention includes the modification of any of those machines to include a rotary valve of the kind disclosed herein. It may of course be necessary to modify the arrangement for driving the rotary valve and/or to modify its speed of rotation.

The construction illustrated could be adapted to form a pump. For example the ignition plugs carburettor and exhaust silencer system could be discarded and a drive motor provided to rotate the shaft 38.

What I claim is:

1. A machine comprising:

(a) a cylinder having a straight sided cylinder bore spaced from a first axis;

(b) a piston assembly including a piston shaped to define a peripheral recess having a floor with two opposite flat portions, said piston being disposed within said cylinder bore to form a chamber therein, said piston assembly further including a connecting member connected to said piston and restraining means for resisting any tendency for the piston to move in relation to said cylinder about said first axis;

(c) an inclined member mounted such that relative rotation between said inclined member and said cylinder occurs about said first axis, said inclined member being inclined to said first axis along a second axis, said connecting member being coupled to said inclined member such that said relative rotation of said cylinder and said inclined member is accompanied by reciprocation of said piston within said cylinder;

(d) valve means for fluid moving through said machine in the use thereof;

said piston assembly also including a piston ring disposed around said piston, said piston ring being moveable as a whole laterally with respect to said piston, and said restraining means comprising a ring-shaped member having two flat internal surface portions which match said two opposite flat portions of said floor of said recess, said ring-shaped member being engaged in said recess in such a way that lateral movement of said piston ring relative to said piston is restricted to a to-and-fro direction which is radial, or which has a major component which is radial, with respect to said second access.

2. A machine comprising:

(a) a cylinder having a straight sided cylinder bore spaced from a first axis;

(b) a piston assembly incliding a piston disposed within said cylinder bore to form a chamber therein, said piston assembly further including a connecting member connected to said piston and restraining means for resisting any tendency of said piston to move in relation to said cylinder about said first axis.

(c) an inclined member mounted such that relative rotation between said inclined member and said cylinder occurs about said first axis, said inclined member being inclined to said first axis along a second axis, said connecting member being coupled to said inclined member such that said relative rotation of said cylinder and said inclined member is accompanied by reciprocation of said piston within said cylinder;

(d) valve means for fluid moving through said machine in the use thereof;

said piston assembly also including a piston ring disposed around said piston; said piston ring being moveable as a whole laterally with respect to said piston, said piston ring having a composite structure consisting of two concentric ring-shaped members which adhere to one another, and which are made from materials of differing coefficients of expansion so as to obtain an effective overall coefficient of expansion which is such that the piston ring and the cooperating cylinder expand by substantially the same amount during operation of the machine, and said restraining means comprising means for restricting the lateral movement of said piston ring relative to said piston to a to-and-fro direction which is radial, or which has a major component which is radial, with respect to said second axis.

3. A machine according to claim 1 or 2, wherein said piston ring has a periphery in the shape of an equatorial region of a sphere whose radius is equal to that of the cooperating cylinder.

4. A machine according to claim 1 or 2, wherein at least a surface of said piston ring is made of synthetic plastics material.

5. A machine according to claim 1 or 2, wherein said valve means comprises a rotary valve which communicates with said chamber, said valve and said cylinder being disposed for relative rotation, in use, about an axis parallel to or coincident with said first axis.

6. A machine according to claim 5, wherein there are three cylinders spaced around said first axis, and wherein said piston assembly comprises three pistons disposed within respective ones of said three cylinders, said machine being constructed as a four stroke internal combustion engine and said rotary valve being arranged to rotate about said first axis at one-and-a-half times the speed of the machine and to communicate sequentially with said three cylinders.

* * * * *